United States Patent [19]

Lavery

[11] 4,355,758

[45] Oct. 26, 1982

[54] CARTON WITH WINDOW AND HANGING PANEL AND CARTON BLANK THEREFOR

[75] Inventor: John J. Lavery, Chicago, Ill.

[73] Assignee: Champion International Corporation, Stamford, Conn.

[21] Appl. No.: 242,016

[22] Filed: Mar. 9, 1981

[51] Int. Cl.[3] ..... B65D 5/10; B65D 25/22

[52] U.S. Cl. ..... 229/39 R; 206/45.31; 206/806

[58] Field of Search ..... 229/39 R, 37 R; 206/806, 45.31

[56] References Cited

U.S. PATENT DOCUMENTS

| | | | |
|---|---|---|---|
| 3,190,440 | 6/1965 | Palmer | 229/39 R |
| 3,659,704 | 5/1972 | Collura | 206/45.31 |
| 3,870,221 | 3/1975 | Zeitter | 206/45.31 |
| 3,899,124 | 8/1975 | Desmond | 229/39 R |
| 4,069,917 | 1/1978 | Stollberg | 229/39 R |
| 4,209,092 | 6/1980 | Jones | 229/39 R |
| 4,307,834 | 12/1981 | Roccaforte | 229/39 R |

*Primary Examiner*—Herbert F. Ross

*Attorney, Agent, or Firm*—Evelyn M. Sommer; William W. Jones

[57] ABSTRACT

A paperboard windowed carton to display the front area of its contents is formed from a one-piece carton blank. The carton comprises a front panel, a back panel, and two opposite side panels, with the front panel having a window preferably covered with a transparent film such as cellophane. Top panels form a hanging panel and the top enclosure for the carton and bottom panels form its bottom closure. The top panels include a rectangular top flap, a rectangular hanging panel having an orifice and three free sides, and four triangular panels which, in the erected carton, form sides for the hanging panel.

4 Claims, 2 Drawing Figures

CARTON WITH WINDOW AND HANGING PANEL AND CARTON BLANK THEREFOR

BACKGROUND OF THE INVENTION

The present invention relates to one-piece carton blanks and the cartons erected therefrom, and more particularly to such cartons having windows in their front panels for displaying merchandise within the cartons and a hanging panel having an orifice therethrough.

It is often desirable that the items within a carton be displayed to potential customers and that the carton have some means by which it may be hung. An alternative to displaying the item is to print its drawing or picture on the carton. However, the picture may not fully or fairly portray the item, particularly if the item is complex in shape or intended for children. For example, a picture of a Christmas toy may not be nearly as realistic or life-like, particularly to a child, as seeing the toy itself.

Some cartons now display their contents by means of a window on the front panel. However, generally the window is only a part of the area of the panel and the top portion of the item may be hidden. The top portion of the front panel, which frequently is of paperboard instead of a transparent material, may obscure the top portion of the item within the carton.

It may also be desirable that cartons have a hanging panel from which the carton may be hung. A hanging panel enables the carton to be hung on a protruding rod or wire by means of a hole within the hanging panel.

OBJECTIVES AND FEATURES OF THE INVENTION

It is an objective of the present invention to provide a carton manufactured from a one-piece paperboard carton blank which provides a window area through which the item within the carton may be viewed and which provides a hanging panel with which the carton may be hung from a protruding wire or rod.

It is a further objective of the present invention to provide such a carton which, after it has been erected and the item inserted, may be readily closed by a simple hand or machine motion.

It is a further objective of the present invention to provide such a carton in which the window is covered by a transparent film material which protects the item within the carton and yet enables the potential customer to see the front face of the item.

It is a further objective of the present invention to provide such a carton which may be manufactured using conventional carton-making machinery and technology from a one-piece paperboard blank so as to be reasonable in cost.

It is a feature of the present invention to provide a carton blank and the carton formed therefrom. The erected carton comprises a windowed front panel, a back panel having an upper portion with an opening therethrough, and two side panels. Top panels form a top closure and a hanging panel. The top panels include a rectangular top flap articulatedly connected to the front panel and perpendicular thereto, a hanging panel articulatedly connected to the top flap and perpendicular thereto, and triangular panels each connected on an articulated fold line to the top flap and each lying flat against a respective one of the side panels.

BRIEF DESCRIPTION OF THE DRAWINGS

Other objectives and features of the present invention will be apparent from the following detailed description of the invention taken in conjunction with the accompanying drawings. In the drawings.

DETAILED DESCRIPTION OF THE INVENTION

Figure 1:
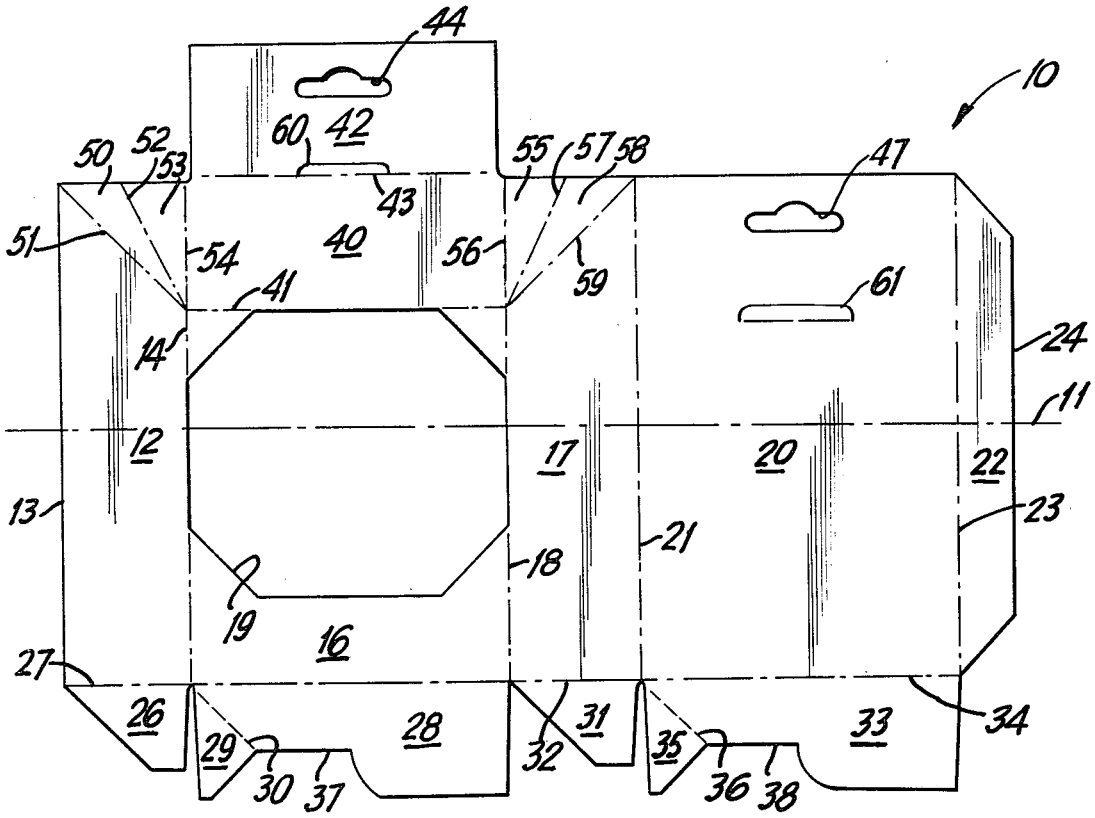
FIG. 1 is a top plan view of the one-piece paperboard carton blank of the present invention.
Figure 2:
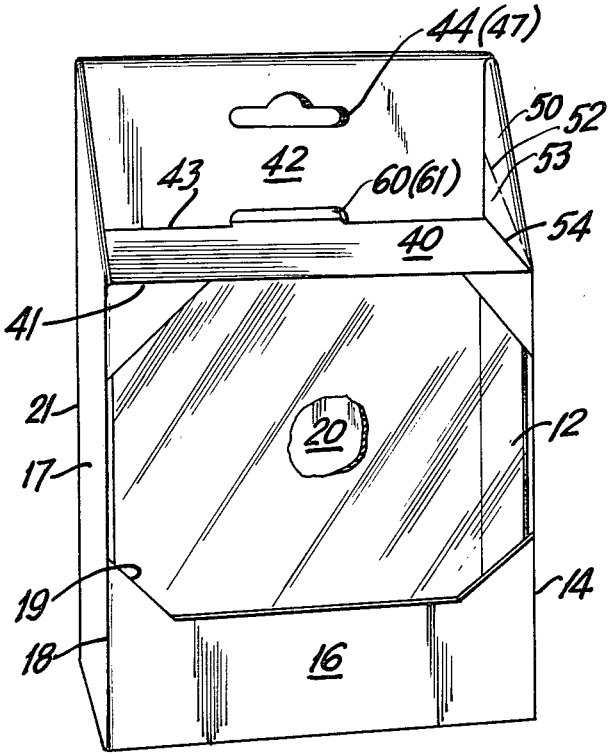
FIG. 2 is a perspective view of the carton which has been erected from the paperboard blank of FIG. 1 and shows the hanging panel.

The one-piece paperboard carton blank 10 of the present invention is shown in FIG. 1 and is preferably made of a coated cardboard. The blank is shown with its back face, the face illustrated in FIG. 1 being the inner face of the erected carton.

The carton blank 10 comprises a series of center panels connected together along articulated fold lines. The center panels are connected along an imaginary central axis 11. the first center panel is first side panel 12 having a free outer edge 13 and a fold line 14 opposite and parallel thereto. The front panel 16 is connected to the first side panel 12 by the fold line 14 and is connected to the second side panel 17 by the fold line 18.

The front panel 16 has a window 19. Preferably the window area extends the full width of the panel 16. The window 19 is preferably covered by a transparent sheet of material such as a film of cellophane (not shown in FIG. 1). The transparent sheet would be adhered at its top and bottom edges to the rear side of the panel 16, and the side edges of the transparent sheet would be adhered to the rear faces of the first side panel 12 and the second side panel 17. The back panel 20 is connected to the second side panel 17. The back panel 20 is connected to the second side panel 17 by the fold line 21. The back panel 20 is connected to the side glue panel 22 by the fold line 23. The side glue panel 22 has a free edge 24 and an adhesive area on its front face (not shown in FIG. 1).

A series of flap members are connected to the center panels in order to form the bottom closure of the erected carton. These bottom flap members include a first bottom flap 26 which is connected to the side panel 12 by the fold line 27. The second bottom flap 28 is connected to a triangular flap 29 by the fold line 30. A third bottom flap 31 is connected to the second side flap 17 by the fold line 32. A fourth bottom flap 33 is connected to the back panel 20 by the fold line 34 and is connected to its triangular flap 35 by the fold line 36. Preferably the first bottom flap 26 is of the same size and shape as the third bottom flap 31 and the second and fourth bottom flaps 28 and 33 are of the same size and shape as each other. Both the second bottom flap 28 and the fourth bottom flap 33 have, respectively, indented portions 37,38 which are of a sufficient size to permit the insertion of fingers.

A series of top closure panels are arranged along the top of the carton blank and form the top closure of the carton. These top closure panels include a rectangular top flap 40 which is connected to the front panel 16 by the fold line 41 and which is connected to the hanging panel 42 by the fold line 43. The back panel 20 is the same height as the combined heights of the panel 16 and the top flap 40. The hanging panel 42 has three free edges and a shaped orifice 44. A shaped orifice 47 in the back panel 20 is preferably of the same size and shape as the orifice 44 in back panel 20.

A first triangular panel 50 is connected by fold line 51 to the first side panel 12 and connected by a fold line 52 to the second triangular panel 53, which second triangular panel 53 is connected to the top flap 40 by the fold line 54. Similarly, a third triangular panel 55 is connected by fold line 56 to the top flap 40 and connected by fold line 57 to the triangular panel 58. The triangular panel 58 is connected by the fold line 59 to the second side panel 17.

The hanging panel 42 has a tab 60 formed by fold line 43 and a cut line in the form of a wide inverted U. The tab fits in an opening formed by a similar, but slightly larger, cut tab 61 in back panel 20.

The carton is erected from the one-piece carton blank by folding along the indicated fold lines. The front face of the side glue panel 22 is adhered to the inside rear face of the first side panel 12. The item to be displayed is inserted into the erected carton and the carton is closed by folding of the bottom flap members 26, 28, 31 and 33 which interlock to retain the item within the carton. Then the top flap 40 is folded so that it is perpendicular to the front panel 16 and forms a false platform, on top, to keep the item in position so that it may be viewed through the window.

The folding of the top flap 40 into position causes the hanging panel 42 to lie against the top rear face of the back panel 40 with its orifice 44 aligned with the back panel orifice 61. The aligned orifices provide a means to hang the carton on a rack for display. The tab 60 fits within the opening formed by cut tab 61 to form a lock to prevent pilferage of the item from the carton. The triangular panels 50,53 and 55,58 form opposite sides which are perpendicular to the top flap 40 and which provide a 45° slanted top.

What is claimed is:

1. A paperboard windowed carton formed from a one-piece carton blank comprising:

a plurality of central panels joined along articulated fold lines and including a front panel, its opposite back panel having an opening therein for hanging the carton and having an upper portion thereof extending in height beyond the height of said front panel, and two opposite side panels, said front panel having a window therein adapted to show the front of the carton's contents;

a plurality of bottom panels joined to at least some of said center panels to form a bottom closure for the carton;

a plurality of top panels to form a top closure and a hanging panel, said top panels comprising a rectangular top flap articulatedly connected to said front panel and perpendicular thereto, a hanging panel articulatedly connected to said top flap and perpendicular thereto so that it lies flat against said upper portion of said back panel, said hanging panel having an opening therein aligned with said opening in the back panel, and two pairs of first and second triangular panels articulately connected together and both triangular panels of each pair being substantially coplanar and lying flat against a respective one of said side panels, with one of said triangular panels in each pair being articulately connected to said top flap and the other triangular panel of each pair being articulately connected to a respective one of said side panels.

2. A carton as in claim 1 wherein said window is the entire width of the front panel.

3. A paperboard windowed one-piece carton blank comprising:

a plurality of central panels aligned along a common axis and joined along articulated fold lines, said central panels including a first side panel, a front panel having a window therein adapted to show the front of the carton's contents; a back panel having an opening therein for hanging the carton and having an upper portion thereof extending in height beyond the height of said front panel, and a second side panel;

a plurality of bottom panels joined to at least some of said center panels to form a bottom closure for the carton;

a plurality of top panels to form a top closure and a hanging panel, said top panels comprising a rectangular top flap articulatedly connected to said front panel, said hanging panel articulatedly connected to said top flap along a fold line colinear with a top edge of said back panel, said hanging panel having an opening therein, and a pair of triangular panels each pair connected on articulated fold lines to said top flap and a respective side panel one leg of each said triangular panels lying on said line colinear with said top edge.

4. A carton blank as in claim 3 wherein said window is the entire width of the front panel.

* * * * *